US007438539B2

(12) United States Patent
Kohsokabe et al.

(10) Patent No.: US 7,438,539 B2
(45) Date of Patent: Oct. 21, 2008

(54) HERMETIC TYPE SCROLL COMPRESSOR AND REFRIGERATING AND AIR-CONDITIONING APPARATUS

(75) Inventors: Hirokatsu Kohsokabe, Minori (JP); Kazuto Higa, Chikushino (JP); Kenji Tojo, Moriya (JP); Daisuke Kuboi, Tokyo (JP)

(73) Assignees: Hitachi Air Conditioning Systems Co., Ltd, Tokyo (JP); The Tokyo Electric Power Company, Incorporated, Tokyo (JP)

( * ) Notice: Subject to any disclaimer, the term of this patent is extended or adjusted under 35 U.S.C. 154(b) by 126 days.

(21) Appl. No.: 11/387,908

(22) Filed: Mar. 24, 2006

(65) Prior Publication Data

US 2006/0216182 A1 Sep. 28, 2006

(30) Foreign Application Priority Data

Mar. 24, 2005 (JP) ..... 2005-085416

(51) Int. Cl.
*F04C 18/04* (2006.01)

(52) U.S. Cl. ..... 418/55.6; 418/97

(58) Field of Classification Search ..... 418/55.6, 418/55.5, 57, 97, 99, 270, DIG. 1
See application file for complete search history.

(56) References Cited

U.S. PATENT DOCUMENTS 4,343,599 A * 8/1982 Kousokabe ..... 418/55.6
4,350,479 A * 9/1982 Tojo et al. ..... 418/55.5
4,648,814 A * 3/1987 Shiibayashi ..... 418/55.6
5,249,941 A * 10/1993 Shibamoto ..... 418/55.5
5,520,526 A * 5/1996 Fujio ..... 418/55.5
6,074,186 A * 6/2000 Lifson et al. ..... 418/55.6
6,129,532 A * 10/2000 Kato et al. ..... 418/55.6
6,299,417 B1 * 10/2001 Shin et al. ..... 417/439
6,321,564 B1 * 11/2001 Yamanaka et al. ..... 62/510
6,672,845 B1 * 1/2004 Kim et al. ..... 417/310
6,827,563 B2 * 12/2004 Hiwata et al. ..... 418/55.6
2007/0092390 A1 * 4/2007 Ignatiev et al. ..... 418/55.5

FOREIGN PATENT DOCUMENTS

CN 1404569 3/2003

(Continued)

*Primary Examiner*—Thomas Denion
*Assistant Examiner*—Mary A Davis
(74) *Attorney, Agent, or Firm*—Antonelli, Terry, Stout & Kraus, LLP.

(57) ABSTRACT

A hermetic type scroll compressor according to the invention includes a scroll compressor element in which an end plate of a orbiting scroll and an end plate of a fixed scroll are assembled such that they slide against each other, an electric motor element which drives the scroll compressor element, a hermetic casing housing the scroll compressor element and the electric motor element and holding lubricating oil collected at a bottom thereof, and an oil separator disposed on a discharge side of the scroll compressor element. An interior of the hermetic casing is kept at an intermediate pressure between a suction pressure and a discharge pressure. An oil return mechanism is provided, which intermittently returns lubricating oil from the oil separator to sliding parts of the orbiting scroll end plate and the fixed scroll end plate. The hermetic type scroll compressor 31 can be improved in performance and reliability while promoting cost reduction.

9 Claims, 7 Drawing Sheets

FOREIGN PATENT DOCUMENTS

| | | | |
|---|---|---|---|
| JP | 5-113182 | | 5/1993 |
| JP | 05-133355 | | 5/1993 |
| JP | 05133355 A | * | 5/1993 |
| JP | 2001-055988 | | 2/2001 |
| JP | 2002-188872 | | 7/2002 |
| JP | 2005-36661 | | 2/2005 |
| KR | 2001-0007042 | | 1/2001 |

* cited by examiner

HERMETIC TYPE SCROLL COMPRESSOR AND REFRIGERATING AND AIR-CONDITIONING APPARATUS

CLAIM OF PRIORITY

The present application claims priority from Japanese application JP 2005-085416 filed on Mar. 24, 2005, the content of which is hereby incorporated by reference into this application.

BACKGROUND OF THE INVENTION

1. Field of the Invention

The present invention relates to a hermetic type scroll compressor and a refrigerating and air-conditioning apparatus. Particularly, the present invention is suitably applicable to a hermetic type scroll compressor and a refrigerating and air-conditioning apparatus using carbon dioxide ($CO_2$) as a refrigerant. Examples of a refrigerating and air-conditioning apparatus include equipment provided with a refrigeration cycle system such as air conditioners, refrigerators, and freezers.

2. Description of the Prior Art

As is well known, a scroll compressor element included in a hermetic type scroll compressor is mainly composed of a fixed scroll and a orbiting scroll each having a spiral scroll wrap erected on the corresponding end plate. In the scroll compressor element, the orbiting scroll, without rotating on its own axis relative to the fixed scroll, revolves orbitally at an approximately constant radius, thereby reducing the volume of a working chamber formed between the two scroll wraps and causing working fluid to be compressed. A hermetic type scroll compressor has such a scroll compressor element and an electrical motor element for driving the scroll compressor element both housed in a hermetic casing. Usually, the interior of the hermetic casing is kept at the suction pressure (low pressure) or the discharge pressure (high pressure) of the compressor.

In a scroll compressor using a low-pressure casing, that is, a hermetic casing whose interior is kept at the suction pressure of the compressor, lubricating oil contained in the suction gas changes in movement speed and volume inside the hermetic casing. This causes the lubricating oil to be separated in droplets from the suction gas and to flow into the working chamber in the scroll compressor element. Since the gas compressed in the working chamber flows out directly into an external refrigeration cycle system, sealing of the working chamber has to be maintained using a small amount of lubricating oil. It is therefore necessary to keep each of the gaps between the scroll wraps (axial gaps around end portions of the scroll wraps and radial gaps around sealed side portions of the scroll wraps) small, and doing so causes a problem of cost increase.

On the other hand, in a scroll compressor using a high-pressure casing, that is, a hermetic casing whose interior is kept at the discharge pressure of the compressor, lubricating oil contained in the discharge gas is discharged and separated in the hermetic casing, so that a relatively large amount of lubricating oil can be supplied to the working chamber. This makes it easy to control the gaps between the scroll wraps using oil film seals. Therefore, in the case of a scroll compressor using a high-pressure casing, the problem described above for a scroll compressor using a low-pressure casing does not occur, and it becomes possible to consider a cost reduction. In the case of a scroll compressor using a high-pressure casing, however, the hermetic casing is required to be made of thick material to secure adequate strength against pressure. Meeting the requirement causes a problem of a heavier compressor involving a cost increase.

In particular, from a viewpoint of global warming prevention, natural refrigerants with a small global warming potential have recently been attracting attention as refrigerants to take place of fluorocarbon refrigerants conventionally used for refrigeration systems. A $CO_2$ refrigerant is regarded as having a promising future as a natural refrigerant for refrigerating and air-conditioning equipment. Compared with fluorocarbon refrigerants, the $CO_2$ refrigerant has a low critical temperature of about 31° C., so that the operating pressure of the refrigeration system using the $CO_2$ refrigerant becomes as high as about 10 MPa on the high-pressure side of the system. Therefore, a scroll compressor which uses a high-pressure casing and the $CO_2$ refrigerant requires the casing to be made of particularly thick material. This leads to a problem of a heavier compressor involving a cost increase.

An example of a scroll compressor in which the interior of a hermetic casing is kept at an intermediate pressure between a suction pressure and a discharge pressure is disclosed in the specification of U.S. Pat. No. 4,343,599 (patent document 1). The patent document 1 describes a hermetic type scroll compressor in which the interior of a hermetic casing is kept at an intermediate pressure between a suction pressure and a discharge pressure and which includes an oiling passage and an oil return passage. The oiling passage is composed of a capillary tube. The opening at one end of the capillary tube is disposed in lubricating oil. The opening at the other end of the capillary tube communicates with a suction port of the compressor. The oil return passage is composed of a capillary tube. The opening at one end of the capillary tube communicates with an oil separator disposed on the discharge side of the compressor. The opening at the other end of the capillary tube communicates with the interior of the hermetic casing. According to the patent document 1, keeping the interior of the hermetic casing at an intermediate pressure between a suction pressure and a discharge pressure allows the strength against pressure of the casing to be low as compared with when a high-pressure casing is used, so that increases in weight and cost of the compressor can be suppressed.

Patent document 1: Specification of U.S. Pat. No. 4,343,599

SUMMARY OF THE INVENTION

However, using a $CO_2$ refrigerant for the hermetic type scroll compressor disclosed in the patent document 1 will cause problems as described below.

When a $CO_2$ refrigerant is used for a hermetic type scroll compressor, the operating pressure becomes 3 to 4 times higher than when an ordinary fluorocarbon refrigerant is used and the pressure difference between high and low pressures also increases. In the technique disclosed in the patent document 1, the oil flow rates in the oil return passage and the oiling passage are controlled by adjusting the inside diameter of the corresponding capillary tube. When using the $CO_2$ refrigerant, therefore, it becomes necessary to reduce the inside diameters of the capillary tubes so as to generate a larger resistance against the lubricating oil flowing through the passages. When such an arrangement is made, it becomes easy for foreign objects such as wear particles getting in the passages to obstruct the flow of lubricating oil through the passages. When such a condition occurs, the oil flow control function of the compressor deteriorates to make lubrication of the compressor inadequate, eventually leading to a problem of reduced reliability of the compressor.

Furthermore, in the oil supply passage according to the patent document 1, the lubricating oil collected in the hermetic casing is injected into the suction side of the compressor through an oiling passage, thereby the working chamber interior is well lubricated. In terms of lubrication of the sliding parts of the mutually sliding orbiting scroll end plate and fixed scroll end plate that are subjected to a thrust load, however, no particular arrangement is proposed. In a hermetic type scroll compressor using a $CO_2$ refrigerant, the compressor operation involves a large pressure differential, so that the thrust load to which the sliding parts are subjected also increases. Therefore, to improve the performance and reliability of the compressor, lubrication of the sliding parts subjected to the thrust load is of particular importance.

An object of the present invention is to provide a hermetic type scroll compressor and a refrigerating and air-conditioning apparatus whose performance and reliability can be improved while promoting a cost reduction.

To achieve the above object, the present invention provides a hermetic type scroll compressor including a scroll compressor element in which an end plate of a orbiting scroll and an end plate of a fixed scroll are assembled such that they slide against each other, an electric motor element which drives the scroll compressor element, a hermetic casing housing the scroll compressor element and the electric motor element and holding lubricating oil collected at a bottom thereof, and an oil separator disposed on the discharge side of the scroll compressor element. The interior of the hermetic casing is kept at an intermediate pressure between a suction pressure and a discharge pressure. The hermetic type scroll compressor incorporates an oil return mechanism which intermittently returns lubricating oil from the oil separator into the hermetic casing.

A preferred configuration of the present invention is as follows.

(1) The oil return mechanism includes an oil return passage and an oil pocket. The oil return passage communicates with the oil separator. It has an opening in the sliding surface of the fixed scroll end plate. The oil pocket is formed on the sliding surface of the orbiting scroll endplate. It communicates alternately with the oil return passage and the space in the hermetic casing as the orbiting scroll revolves.

(2) In addition to what is described in (1) above, an annular groove which constantly communicates with the space in the hermetic casing is formed on the sliding surface of the fixed scroll end plate. The oil pocket is formed such that it alternately communicates with the oil return passage and the annular groove.

(3) In addition to what is described in (1) above, the oil return passage included in the oil return mechanism has a vertical hole having an opening in the sliding surface of the fixed scroll end plate and a horizontal hole having an opening in the side surface of the fixed scroll end plate. The oil return mechanism has an oil return pipe which, extending from the oil separator disposed outside the hermetic casing and through the hermetic casing, communicates with the horizontal hole formed in the oil return passage.

The present invention provides a hermetic type scroll compressor including a scroll compressor element in which an end plate of a orbiting scroll and an end plate of a fixed scroll are assembled such that they slide against each other, an electric motor element which drives the scroll compressor element, a hermetic casing housing the scroll compressor element and the electric motor element and holding lubricating oil collected at a bottom thereof, and an oil separator disposed on the discharge side of the scroll compressor element. The interior of the hermetic casing is kept at an intermediate pressure between a suction pressure and a discharge pressure. The hermetic type scroll compressor incorporates an oil return mechanism which intermittently returns lubricating oil from the oil separator into the hermetic casing and an oil supply mechanism which intermittently supplies lubricating oil from around the circumference of the orbiting scroll end plate to the sliding parts of the mutually sliding orbiting scroll end plate and fixed scroll end plate.

A preferred configuration of the present invention is as follows.

(1) The oil supply mechanism includes plural oiling grooves formed on the sliding parts of the orbiting scroll end plate and the fixed scroll end plate such that the plural oiling grooves intermittently communicate with the space around the circumference of the orbiting scroll end plate.

(2) In addition to what is described in (1) above, the oil supply mechanism has oiling grooves formed on the sliding part along the entire circumference thereof, of the orbiting scroll end plate, and an annular groove formed on the sliding part of the fixed scroll end plate such that it intermittently communicates with the oiling groove as the orbiting scroll revolves.

(3) Carbon dioxide is used as working fluid.

The present invention provides a refrigerating and air-conditioning apparatus which has a refrigeration cycle system in which a hermetic type scroll compressor, a gas cooler, an expansion valve and an evaporator are connected with refrigerant piping. The apparatus uses carbon dioxide as a refrigerant for the refrigeration cycle system. It has a hermetic casing the interior of which is kept at an intermediate pressure between a suction pressure and a discharge pressure. The hermetic type scroll compressor includes a scroll compressor element in which an end plate of a orbiting scroll and an end plate of a fixed scroll are assembled such that they slide against each other, an electric motor element which drives the scroll compressor element, a hermetic casing housing the scroll compressor element and the electric motor element and holding lubricating oil collected at a bottom thereof, an oil separator disposed on the discharge side of the scroll compressor element, and an oil return mechanism which intermittently returns lubricating oil from the oil separator into the hermetic casing.

A preferred configuration of the present invention is as follows.

(1) The oil return mechanism includes an oil return passage and an oil pocket. The oil return passage communicates with the oil separator. It has an opening in the sliding surface of the fixed scroll end plate. The oil pocket is formed on the sliding surface of the orbiting scroll end plate. It communicates alternately with the oil return passage and the space in the hermetic casing as the orbiting scroll revolves.

(2) An oil supply mechanism which intermittently supplies lubricating oil from around the circumference of the orbiting scroll end plate to the sliding parts of the mutually sliding orbiting scroll end plate and fixed scroll end plate is provided.

The present invention provides a hermetic type scroll compressor and a refrigerating and air-conditioning apparatus whose performance and reliability can be improved while promoting a cost reduction.

DETAILED DESCRIPTION OF THE PREFERRED EMBODIMENTS

Figure 1:
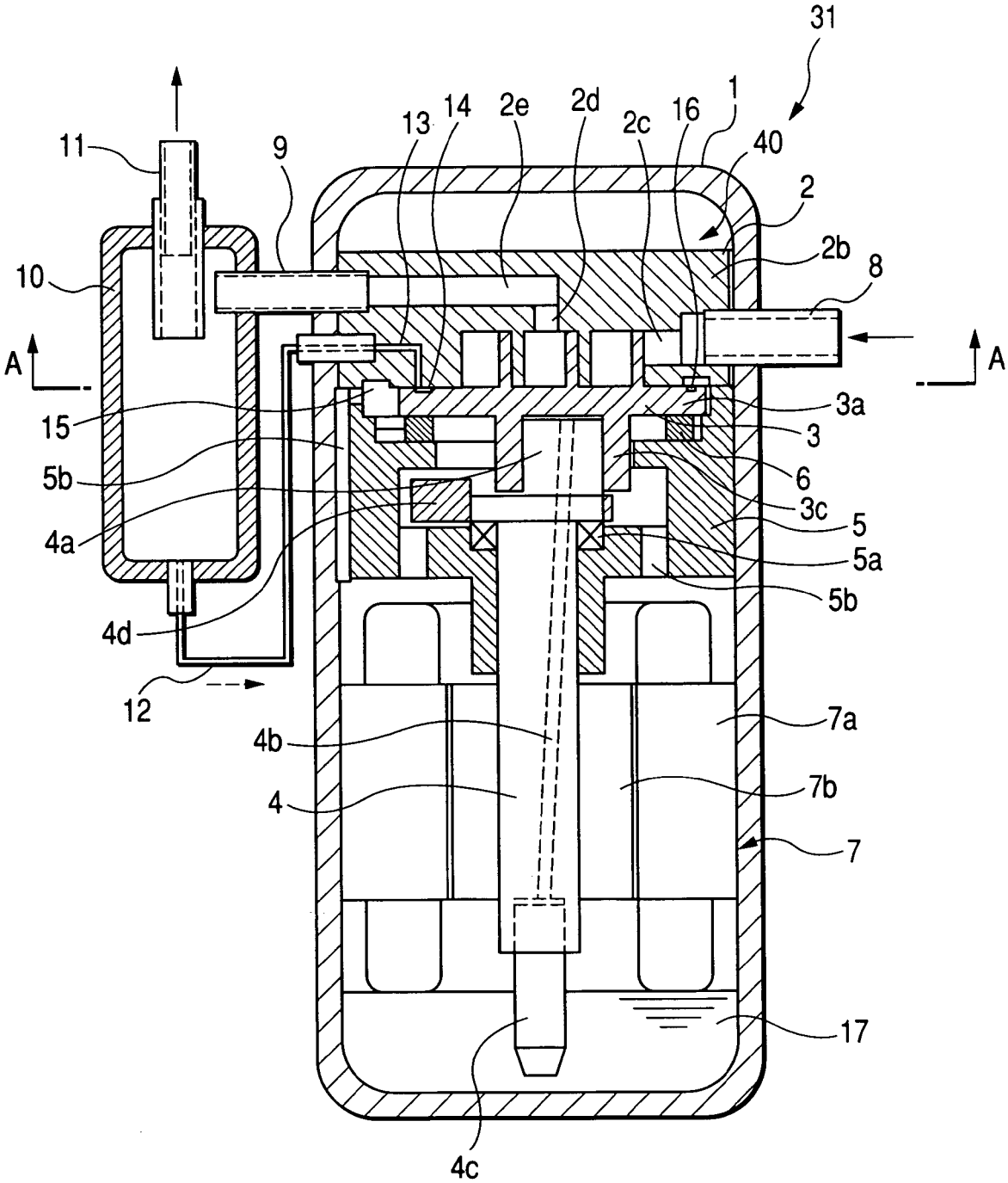
FIG. 1 is a longitudinal sectional view of a hermetic type scroll compressor according to a first embodiment of the present invention.

Plural embodiments of the present invention will be described in the following with reference to the accompanying drawings. The same reference numerals used in the accompanying drawings denote the same or equivalent items.

First, a first embodiment of a hermetic type scroll compressor according to the present invention will be described with reference to FIGS. 1 to 5.

Figure 2:
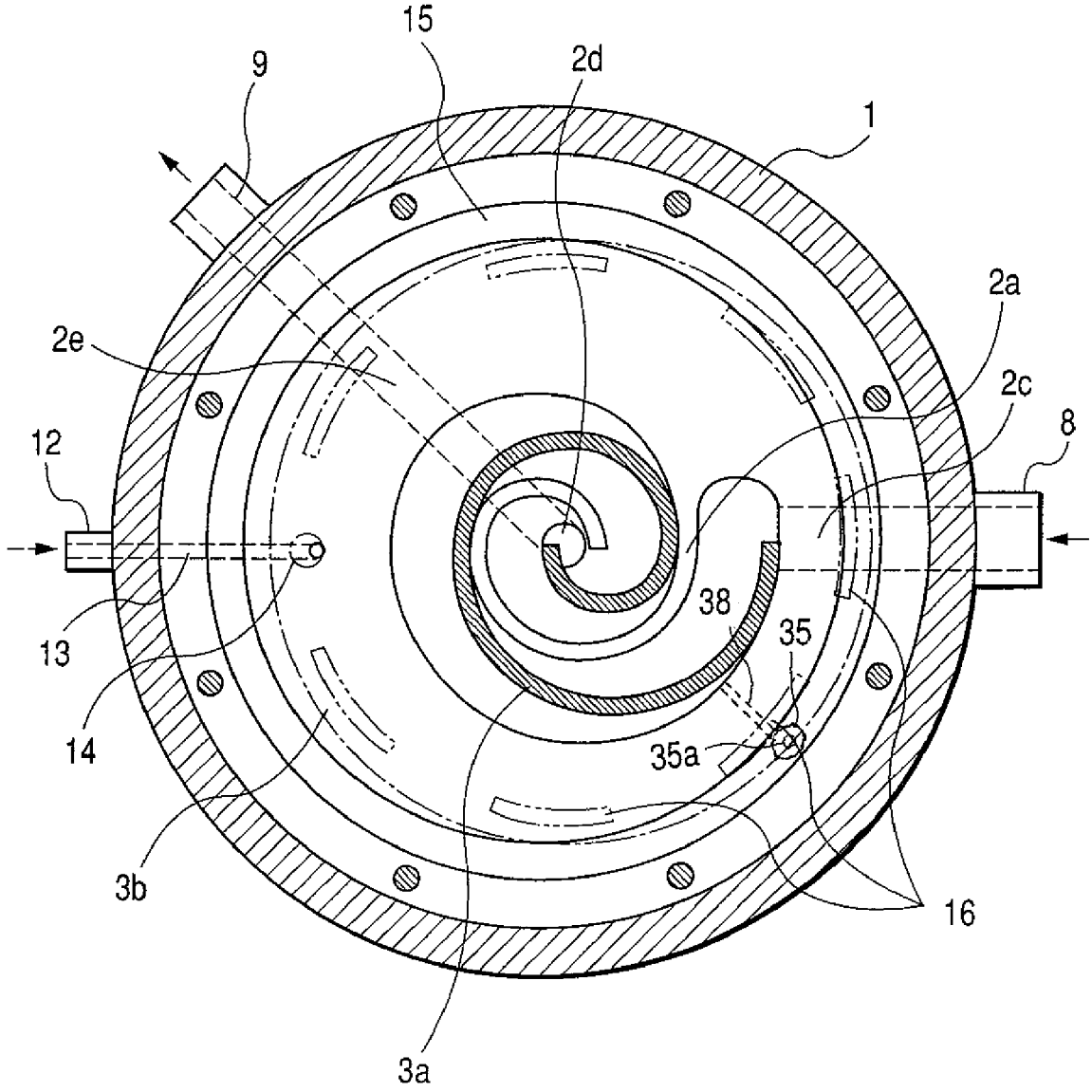
FIG. 2 is a cross-sectional view taken along line A-A in FIG. 1.
Figure 3:
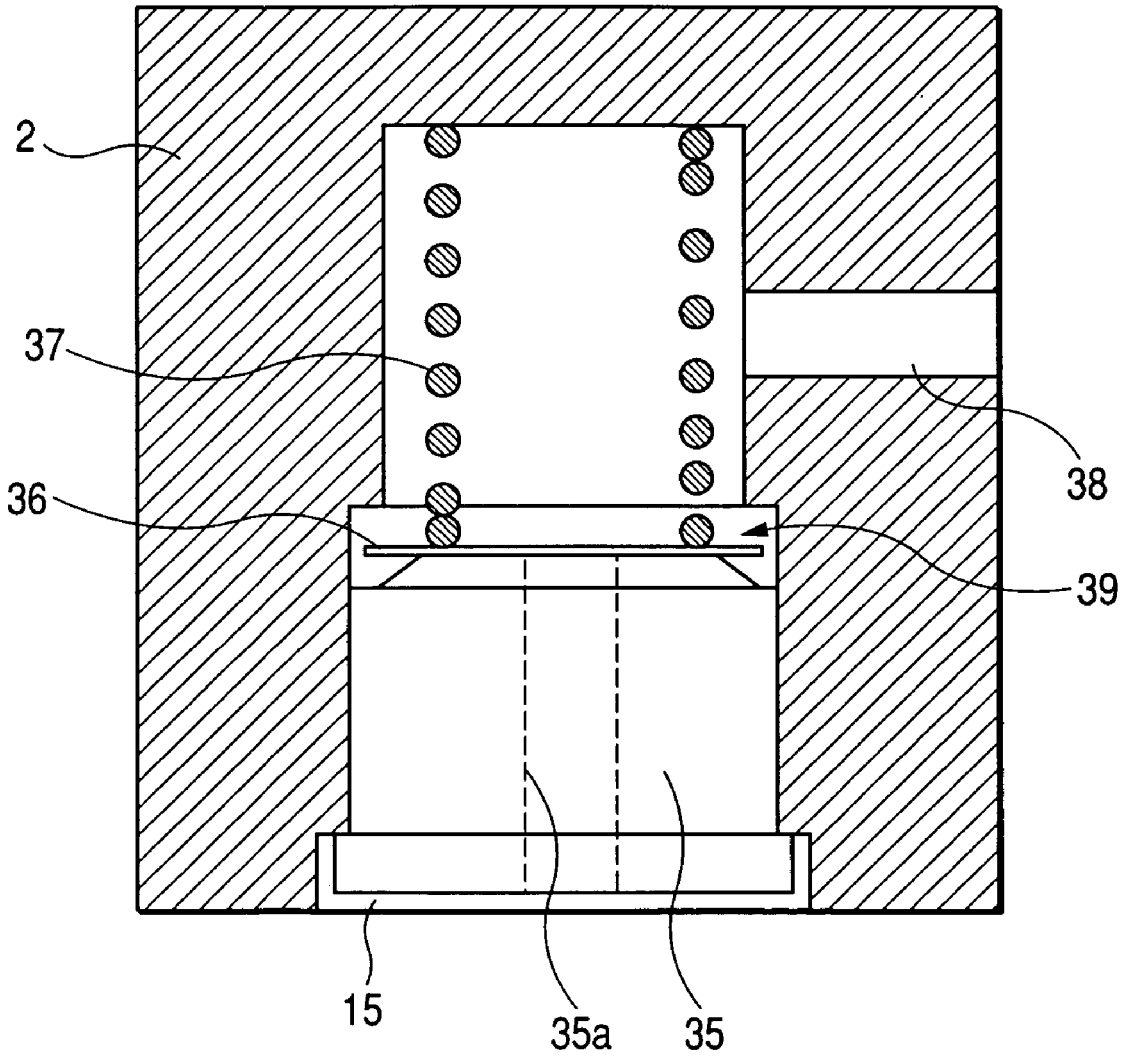
FIG. 3 is an enlarged view of a principal part of the hermetic type scroll compressor according to the first embodiment, illustrating an intermediate pressure adjusting mechanism.

An overall configuration of a hermetic type scroll compressor 31 according to the present embodiment will be described below with reference to FIGS. 1 to 3. FIG. 1 is a longitudinal sectional view of the hermetic type scroll compressor 31 according to the present embodiment. FIG. 2 is a cross-sectional view taken along line A-A in FIG. 1. FIG. 3 is an enlarged view of a principal part of the hermetic type scroll compressor 31, illustrating an intermediate pressure adjusting mechanism.

Reference numeral 1 denotes a hermetic casing. It houses a fixed scroll 2 and a orbiting scroll 3 which are principal parts of a scroll compressor element 40. The hermetic casing 1 is basically shaped like a vertical cylinder. The fixed scroll 2 is composed of a spiral fixed scroll wrap 2*a* and a fixed scroll end plate 2*b* on which the spiral fixed scroll wrap 2*a* is erected upright. The fixed scroll 2 is mounted on a frame 5 to which it is fixed with bolts. The fixed scroll end plate 2*b* has a suction port 2*c* and a discharge port 2*d*. The suction port 2*c* is formed in a circumferential portion of the fixed scroll end plate 2*b*. It has an opening in the side of the fixed scroll end plate 2*b*. The discharge port 2*d* is formed in a central portion of the fixed scroll end plate 2*b*. It has an opening in the bottom of the fixed scroll end plate 2*b*. An outlet passage 2*e* communicates with the discharge port 2*d* having an opening in the side of the fixed scroll end plate 2*b*. The orbiting scroll 3 is composed of a orbiting scroll wrap 3*a* and a orbiting scroll end plate 3*b* on which the orbiting scroll wrap 3*a* is erected upright. A orbiting bearing 3*c* is provided in a central portion of the face that is opposite to the face on which the orbiting scroll wrap 3*a* is erected, of the orbiting scroll end plate 3*b*. The orbiting scroll 3 is disposed in a space surrounded by the fixed scroll 2 and a frame 5.

Reference numeral 4 denotes a crankshaft which drives, using its eccentric part 4*a*, the orbiting scroll 3; 4*b* an oiling hole formed in the crankshaft 4; 4*c* an oiling piece fit to a lower end portion of the crankshaft 4; and 4*d* a balance weight attached to the crankshaft 4. Reference numeral 5 denotes a frame which rotatably supports the crankshaft 4; 5*a* a main bearing installed in a central portion of the frame 5; and 5*b* an oil recovery passage through which lubricating oil pooled inside the frame 4 is returned to the bottom of the hermetic casing 1. Reference numeral 6 denotes an Oldham ring which prevents the orbiting scroll 3 from rotating on its own axis. Reference numeral 7 denotes an electric motor element which is accommodated in a lower portion of the hermetic casing 1 and which rotatingly drives the crankshaft 4. The electric motor element 7 is composed of a stator 7*a* and a rotor 7*b*.

Reference numeral 8 denotes a suction pipe through which working fluid, i.e., $CO_2$ used as a refrigerant, flows in from an external refrigerating circuit; and 9 a discharge pipe through which the working fluid compressed in a scroll compressor element 40 is discharged. Reference numeral 10 denotes an oil separator which separates lubricating oil mixed in the discharged working fluid. A discharge pipe 11 for discharging the working fluid, from which the lubricating oil has been removed, to an external refrigeration cycle system is connected to an upper part of the oil separator 10. An oil return pipe 12 for returning the lubricating oil removed from the working fluid into the hermetic casing 1 is connected to a lower part of the oil separator 10.

Reference numeral 13 denotes an oil return passage formed in the fixed scroll 2, and 14 an oil pocket which is a concave part formed on a sliding surface of the orbiting scroll end plate 3*b*. The oil return passage 13 communicates with the oil separator 10 through the oil return pipe 12. It has an opening in a sliding surface of the fixed scroll end plate 2*b*. The oil return passage 13 has a vertical portion leading to the opening in the sliding surface of the fixed scroll end plate 2*b* and a horizontal portion leading to an opening in the side of the fixed scroll end plate 2*b*. The oil pocket 14 is circularly formed with a diameter larger than that of the oil return passage 13. As the orbiting scroll 3 revolves, the oil pocket 14 communicates alternately with the oil return passage 13 and the space in the hermetic casing 1 (that is, to be concrete, the space in an annular groove 15).

Reference numeral 15 denotes an annular groove formed on a surface of the fixed scroll end plate 2*b*, and 16 an oiling groove formed on the sliding surface of the orbiting scroll end plate 3*b*. Reference numeral 17 denotes lubricating oil accumulated at the bottom of the hermetic casing 1. The annular groove 15 is formed on the sliding surface of the fixed scroll end plate 2*b* such that, while constantly communicating with the space in the hermetic casing 1, it intermittently communicates with the oiling groove 16 as the orbiting scroll 3 revolves. A plurality of the oiling grooves 16 are formed on the sliding parts of the orbiting scroll end plate 3*b* and the fixed scroll end plate 2*b* such that the oiling grooves 16 intermittently communicate with the space around the circumference of the orbiting scroll end plate 3*b*.

To carry out gas compression operation, the hermetic type scroll compressor 31 according to the present embodiment operates as follows. When the electric motor element 7 is energized, the crankshaft 4 rotates to drive the orbiting scroll 3. The orbiting scroll 3 being prevented by the Oldham ring 6 from rotating on its own axis is caused, by the eccentric part 4*a* of the crankshaft 4, to revolve orbitally with a constant radius. As the orbiting scroll 3 revolves, a working chamber formed between the fixed scroll wrap 2*a* and the orbiting scroll wrap 3*a* reduces in volume causing working fluid which has flowed in from the suction pipe 8 and through the suction port 2*c* to be compressed and discharged from the discharge port 2*d* formed in a central portion of the fixed scroll 2 into the hermetic casing 1 through the outlet passage 2*e*.

The interior of the hermetic casing 1 is kept at an intermediate pressure between a suction pressure and a discharge pressure. The intermediate pressure adjusting mechanism for keeping the interior of the hermetic casing 1 at the intermediate pressure has, as shown in FIG. 2 and FIG. 3, a continuous hole 38 through which the interior of the hermetic casing 1 (inside of the annular groove 15) and the interior of the working chamber communicate with each other and a flapper valve which opens and closes the continuous hole 38 at a prescribed intermediate pressure. The flapper valve 39 includes a flapper valve seat 35 having a pressure release hole 35*a*, a flapper valve plate 36 which opens and closes the pressure release hole 35*a*, and a coil spring 37 which presses the flapper valve plate 36 against the flapper valve seat 35. The intermediate pressure can be set to a desired value by adjusting the position of the continuous hole 38 connecting the interior of the hermetic casing 1 and the working chamber or by adjusting the spring force of the coil spring 37 of the flapper valve 39 disposed in the passage connecting the interior of the hermetic casing 1 and the working chamber.

With the interior of the hermetic casing 1 set to the intermediate pressure, the intermediate pressure is applied as a back-pressure to the end plate 3*b* of the orbiting scroll 3 thereby causing the orbiting scroll 3 to be pressed against the fixed scroll 2. The pressing force applied to the orbiting scroll 3 counterbalances the axial thrust load attributable to a compression reaction force and reduces the mechanical friction loss involved. At the same time, the gap at the end portions of the scroll wraps is narrowed, so that sealing of the gap is secured. Keeping the interior of the hermetic casing 1 at the intermediate pressure allows the hermetic casing 1 to be made of a thinner material than allowable in cases where a high-pressure casing is used. This enables cost reduction.

Next, the lubricating action at the sliding parts of bearings will be described with reference to FIG. 1. When the electric motor element 7 is energized, the crankshaft 4 rotates and the lubricating oil 17 accumulated at the bottom of the hermetic casing 1 is pulled up, by centrifugal pumping action of the crankshaft 4, from the oiling piece 4*c* through the oiling hole 4*b* and then supplied to the main bearing 5*a* rotatably supporting the frame 5 and the orbiting bearing 3*c* of the orbiting scroll 3. The lubricating oil having lubricated the bearings flows out into the inside of the frame 5 where it lubricates the sliding part of the Oldham ring 6 and the sliding part of the orbiting scroll end plate 3*b*. Subsequently, the lubricating oil is recovered, through the oil recovery passage 5*b*, into the bottom part where recovered oil is pooled of the hermetic casing 1.

Figure 4A:
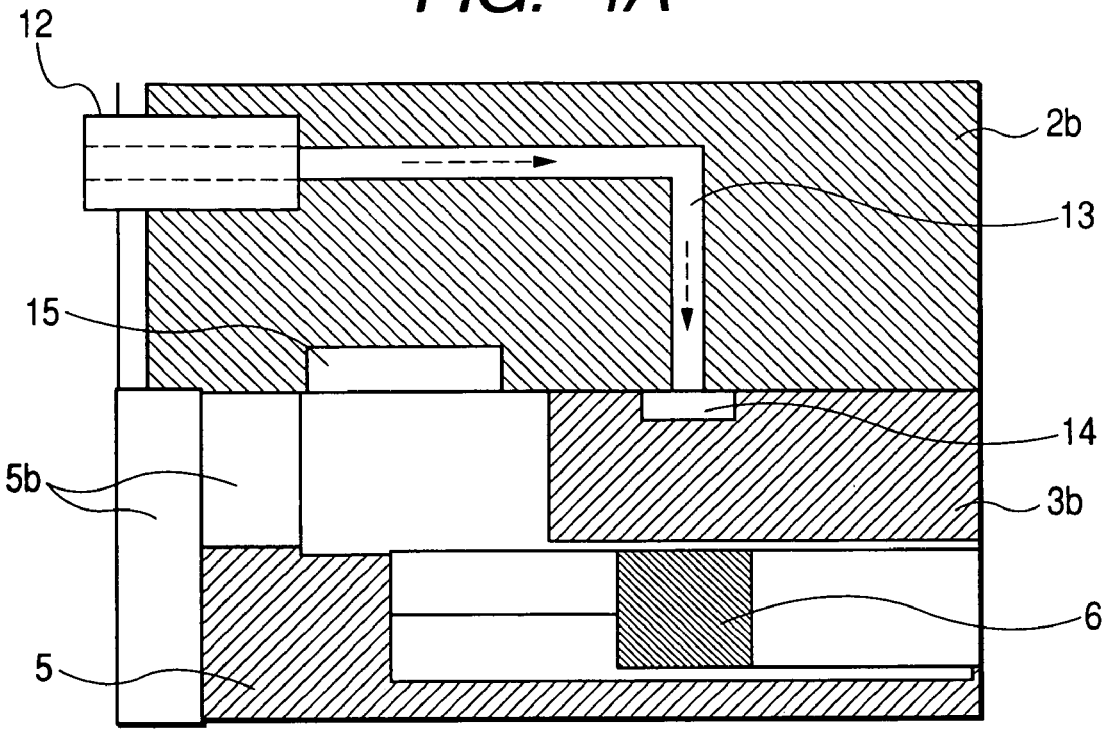
FIGS. 4A and 4B are enlarged views of a principal part of the hermetic type scroll compressor according to the first embodiment, illustrating an oil return mechanism.
Figure 4B:
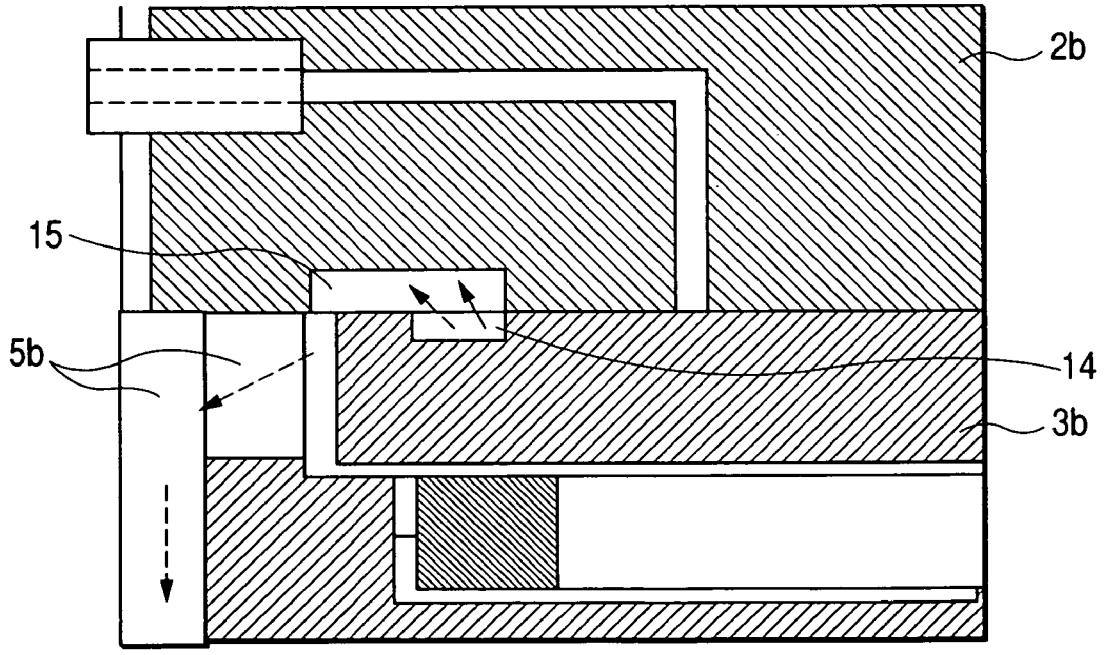

Next, an oil return mechanism of the hermetic type scroll compressor 31 according to the present embodiment will be described with reference to FIGS. 1, 2, 4A and 4B. FIGS. 4A and 4B are enlarged views of a principal part of the hermetic type scroll compressor 31, illustrating an oil return mechanism. FIG. 4A shows a state in which lubricating oil separated at the oil separator 10 has been taken in the oil pocket 14 formed on the sliding surface of the orbiting scroll end plate 3*b* through the oil return pipe 12 and the oil return passage 13 formed in the fixed scroll 2. FIG. 4B shows a state reached when the crankshaft 4 is rotated about 180 degrees from the state shown in FIG. 4A.

The oil separator 10 is installed on the discharge side of the scroll compressor element 40, so that its interior is at discharge pressure. The lubricating oil separated at the oil separator 10 is, as shown by broken-line arrows in FIG. 4A, returned, making use of the difference between the discharge pressure and the intermediate pressure, to the oil pocket 14 kept at the intermediate pressure. Thus, the oil pocket 14 is filled with lubricating oil at the discharge pressure.

When, in the above state, the crankshaft 4 rotates causing the orbiting scroll 3 to revolve, an opening of the oil return passage 13 is closed by the orbiting scroll end plate 3*b* and then the oil pocket 14 starts being communicated with the annular groove 15. In the state shown in FIG. 4B that is reached when the crankshaft 4 rotates 180 degrees from the state shown in FIG. 4A, the oil pocket 14 is entirely communicated with the annular groove 15. With the oil pocket 14 filled with the lubricating oil at the discharge pressure and the annular groove 15 kept at the intermediate pressure, the difference between the discharge pressure and the intermediate pressure causes the lubricating oil in the oil pocket 14 to flow out, as shown by broken-line arrows in FIG. 4B, into the annular groove 15. Thus, the oil return passage 13 and the space inside the hermetic casing 1 do not come to communicate directly with each other. The oil pocket 14 communicates alternately with the oil return passage 13 and the annular groove 15. The lubricating oil having entered the annular groove 15 is eventually recovered into the hermetic casing 1 through the oil recovery passage 5*b*.

As the orbiting scroll 3 in the state shown in FIG. 4B revolves further, the oil pocket 14 is closed from above by the fixed scroll end plate 2*b*. The oil pocket 14 then reaches the state as shown in FIG. 4A where it communicates with the oil return passage 13. Subsequently, this operational cycle is repeated.

In the oil return mechanism used in the present embodiment, lubricating oil is intermittently returned into the hermetic casing making use of the orbiting motion of the orbiting scroll 3, so that the amount of lubricating oil being returned can be reliably controlled without requiring the cross-sectional areas of the oil return pipe 12 and the oil return passage 13 to be reduced. This allows the hermetic type scroll compressor 31 to be made highly reliable. Since the amount of lubricating oil being returned can be reliably controlled even when a $CO_2$ refrigerant is used as a working fluid, operation is possible without contributing to global warming. The amount of oil being returned can be arbitrarily adjusted by changing the volumetric capacity of the oil return pocket 14.

Figure 5A:
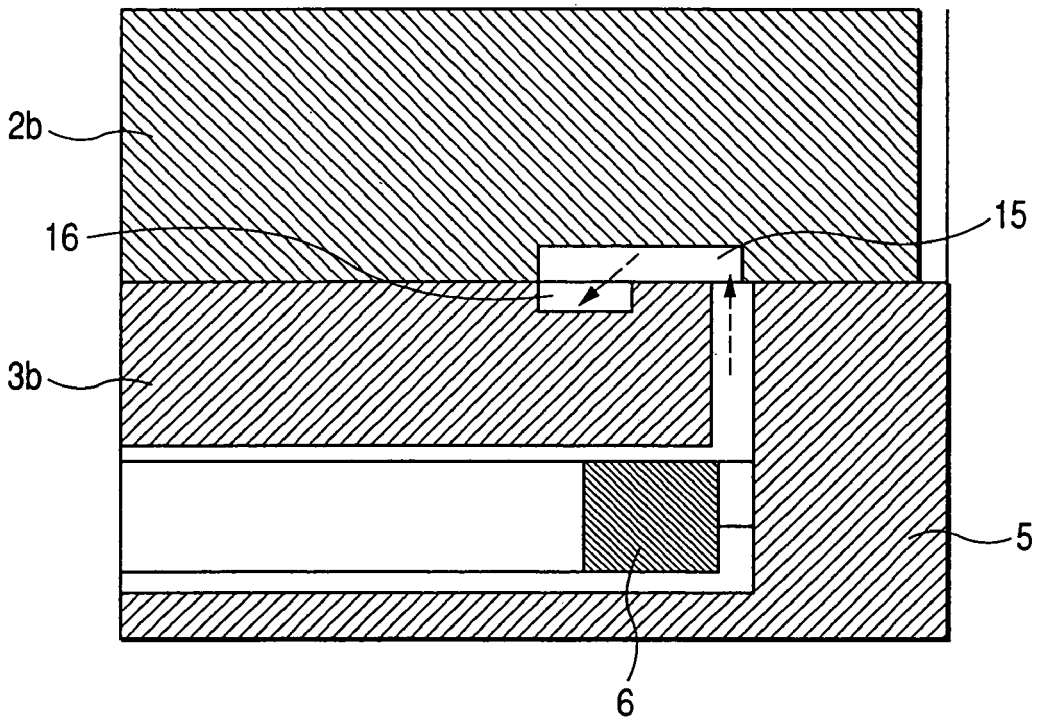
FIGS. 5(A) and 5(B) are enlarged views of a principal part of the hermetic type scroll compressor according to the first embodiment, illustrating an oiling mechanism for the sliding parts of end plates.
Figure 5B:
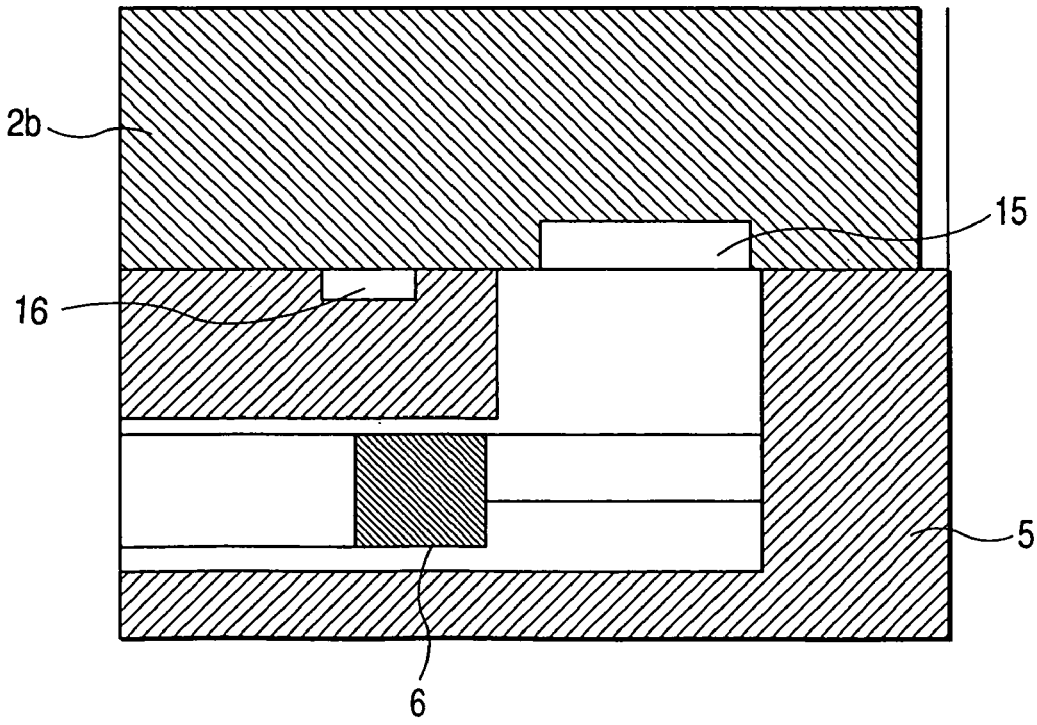

Next, an oiling mechanism for the sliding parts of the end plates included in the hermetic type scroll compressor 31 according to the present embodiment will be described with reference to FIGS. 1, 2, and 5. FIGS. 5(A) and 5(B) are enlarged views of a principal part of the hermetic type scroll compressor 31, illustrating an oiling mechanism for the sliding parts of the end plates. FIG. 5(A) shows a state in which lubricating oil collected in the space around the circumference of the orbiting scroll end plate 3*b* has been taken in the oiling groove 16 formed on the orbiting scroll end plate 3*b* via the annular groove 15 formed on the fixed scroll end plate 2*b*. FIG. 5(B) shows a state which is reached when the crankshaft 4 rotates about 180 degrees from the state shown in FIG. 5(A) and in which the lubricating oil has been introduced to the sliding parts of the end plates.

The annular groove 15 formed on the fixed scroll end plate 2*b* is, as described above, supplied with the lubricating oil collected, after lubricating the bearings, in the space around the circumference of the orbiting scroll end plate 3*b* or recovered through the oil pocket 14. When the annular groove 15 and the oiling groove 16 communicate with each other as shown in FIG. 5(A), the lubricating oil collected in the annular groove 15 fills the oiling groove 16.

When, in the above state, the crankshaft 4 rotates causing the orbiting scroll 3 to revolve, the oiling groove 16 is closed from above by the fixed scroll end plate 2*b* and it is moved toward the center of the fixed scroll end plate 2*b* as shown in FIG. 5(B). The lubricating oil in the oiling groove 16 lubricates the sliding parts of the fixed scroll end plate 2*b* and the orbiting scroll end plate 3*b*.

As the orbiting scroll 3 in the state shown in FIG. 5(B) revolves further, the oiling groove 16 moves toward the circumference of the fixed scroll end plate 2*b* to communicate with the annular groove 15 as shown in FIG. 5(A). Subsequently, this operational cycle is repeated.

In the oiling mechanism used in the present embodiment, lubricating oil collected in the space around the circumference of the orbiting scroll end plate 3*b* is intermittently supplied to the sliding parts of the fixed scroll end plate 2*b* and the orbiting scroll end plate 3*b*, so that the thrust the sliding parts of the orbiting scroll end plate 3*b* and the fixed scroll end plate 2*b* can be kept well lubricated and so that the hermetic type scroll compressor 31 can be made high in performance and reliability.

As shown in FIG. 2, a plurality of the oiling grooves 16 is provided along the entire circumference of the orbiting scroll end plate 3*b*. This allows the thrust the sliding parts to be even better lubricated.

Figure 6:
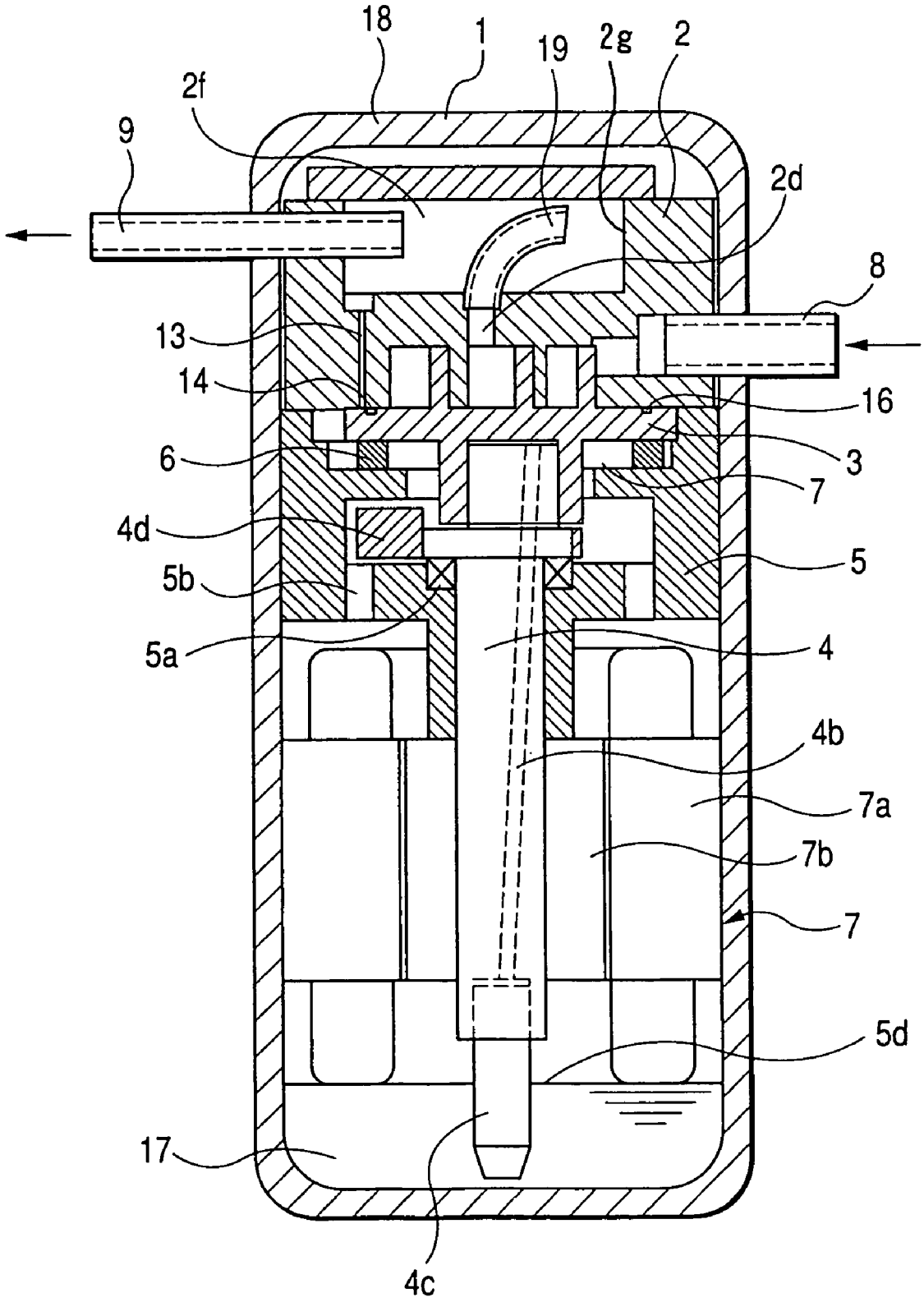
FIG. 6 is a longitudinal sectional view of a hermetic type scroll compressor according to a second embodiment of the present invention.

Next, a hermetic type scroll compressor according to a second embodiment of the present invention will be described with reference to FIG. 6. FIG. 6 is a longitudinal sectional view of a hermetic type scroll compressor 31 according to the second embodiment. The second embodiment differs from the first embodiment in the following respects: in other respects, the second embodiment is basically the same as the first embodiment.

An oil separating space 2*f* and an effluent pipe 19 are shown in FIG. 6. The oil separating space 2*f* is bound by a rising part 2*g* formed on an upper side portion along the entire circumference of the fixed scroll 2 and a discharge cover 18 which closes the upper opening of the rising part 2*g*. One end of the effluent pipe 19 is fitted to the discharge port 2*d*. The other end of the effluent pipe 19 extending in a direction away from an opening end of the discharge pipe 9 faces the side wall of the rising part 2*g*.

In the oil return mechanism used in the present embodiment, the effluent pipe 19 changes the flow direction of the working fluid discharged through the discharge port 2*d*, thereby causing the working fluid to hit the side wall bounding the oil separating space 2*f* and allowing the lubricating oil mixed in the working fluid to be separated. The lubricating oil thus separated collects at the bottom of the oil separating space 2*f* to be subsequently led, through the oil return passage 13, to the sliding parts of the orbiting scroll end plate 3*b* and the fixed scroll end plate 2*b*. As the orbiting scroll 3 revolves, the lubricating oil taken into the oil pocket 14 is intermittently returned to the inside of the hermetic casing 1.

Thus, according to the second embodiment, oil separation is carried out inside the hermetic casing 1, so that no external oil separator is required. As a result, the number of components of the compressor can be reduced to promote cost reduction and reduce the size of the compressor.

Figure 7:
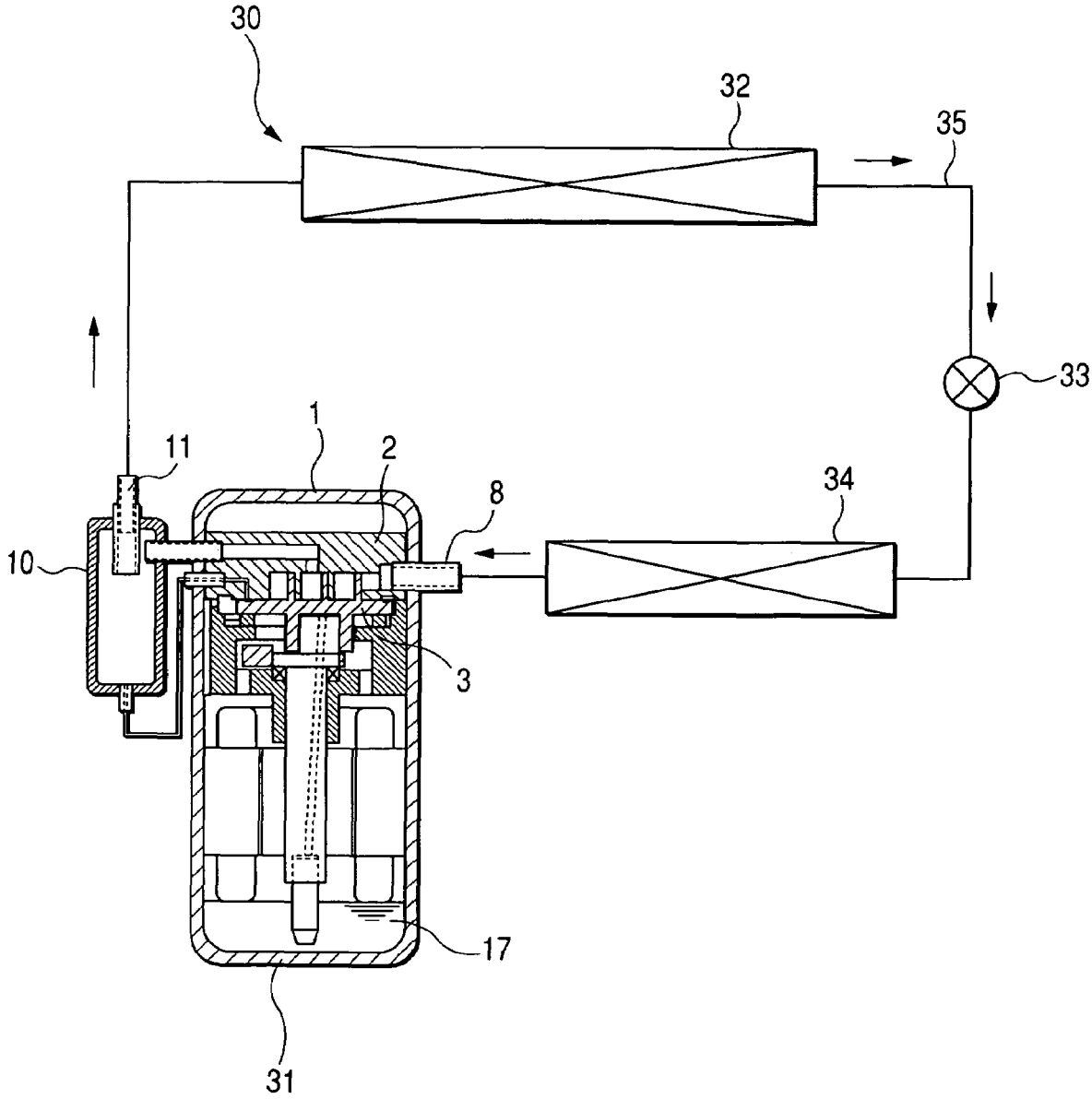
FIG. 7 is a schematic diagram showing a refrigeration cycle system of a refrigerating and air-conditioning apparatus according to a third embodiment.

Next, a refrigerating and air-conditioning apparatus according to a third embodiment of the present invention will be described with reference to FIG. 7. FIG. 7 is a schematic diagram showing a refrigeration cycle system of the refrigerating and air-conditioning apparatus according to the third embodiment.

The refrigerating and air-conditioning apparatus according to the third embodiment incorporates the hermetic type scroll compressor 31 shown in FIG. 1 as a compressor for a refrigeration cycle system 30. The refrigeration cycle system 30 uses a $CO_2$ (carbon dioxide) refrigerant. The $CO_2$ refrigerant is a natural refrigerant which is nontoxic and noncombustible. It is a superior refrigerant from a viewpoint of global environment conservation with its global warming potential (GWP) being as small as one several thousandth of that of a fluorocarbon refrigerant. On the other hand, its critical temperature is as low as about 31° C., so that operation of the refrigerating and air-conditioning apparatus under normal operating condition involves a supercritical cycle in which the operating pressure on the high-pressure side exceeds the critical pressure (about 7 MPa) of the refrigerant. This results in a drawback that, for the high-pressure refrigerant, the theoretical COP (coefficient of performance) is low on a Mollier diagram. Hence, efficiency enhancement of the equipment and refrigeration cycle system to be used is strongly required.

In FIG. 7, reference numeral 32 denotes a gas cooler (radiator), 33 an expansion valve, and 34 an evaporator. The hermetic type scroll compressor 31, the gas cooler (radiator) 32, the expansion valve 33, and the evaporator 34 which are connected with refrigerant piping 35 make up a refrigeration cycle system. In the refrigeration cycle system 30, the refrigerant discharged from the scroll compressor 31 is in supercritical condition being at high temperature and high pressure. The refrigerant enters the oil separator 10 where lubricating oil mixed in the refrigerant is separated. The refrigerant then exits the oil separator 10 through the discharge pipe 11 and enters the gas cooler 32 where its temperature is lowered by heat radiation. After leaving the gas cooler 32, the refrigerant enters the expansion valve 33 from which it is discharged as low-temperature, low-pressure, gas-liquid two-phase refrigerant. The gas-liquid two-phase refrigerant discharged from the expansion valve 33 enters the evaporator 34 where it absorbs heat and is gasified. The gasified refrigerant returns, through the suction pipe 8, to the hermetic type scroll compressor 31 where it is compressed again to be made high-temperature, high-pressure refrigerant in supercritical condition. This cycle is repeated for freezing operation (refrigeration).

In the refrigeration cycle system 30 incorporating the scroll compressor 31 shown in FIG. 1, the lubricating oil separated in the oil separator 10 can be returned into the hermetic casing 1 without fail, so that the hermetic casing 1 can constantly and stably hold lubricating oil. This allows the hermetic type scroll compressor 31 to be made highly reliable and efficiency of the refrigeration cycle system 30 to be improved. With an oiling mechanism for supplying lubricating oil to the sliding parts of the orbiting scroll end plate 3*b* and the fixed scroll end plate 2*b* also incorporated, the thrust the sliding parts of the end plates can be kept well lubricated and the hermetic type scroll compressor 31 can be made high in performance and reliability. A refrigeration cycle system which uses a high-pressure refrigerant such as a $CO_2$ refrigerant, in particular, is subjected to a large pressure difference between a high-pressure state and a low-pressure state of the refrigerant. In such a system, it is important to reduce friction loss at the sliding parts. The above arrangement makes it possible to improve performance and reliability of the refrigeration cycle system 30 that uses a $CO_2$ refrigerant. Furthermore, the interior of the hermetic casing 1 is held at an intermediate pressure between a suction pressure and a discharge pressure. Since the intermediate pressure is close to the pressure at which the refrigeration cycle system is balanced in a non-operating state, changes in pressure to which the hermetic casing 1 is subjected are small. Hence, the pressure capacity of the hermetic casing 1 is allowed to be relatively low. This makes it possible to reduce the weight and production cost of the compressor.

What is claimed is:

1. A hermetic type scroll compressor comprising:

a scroll compressor element in which an end plate of a orbiting scroll and an end plate of a fixed scroll are assembled such that a sliding surface of the end plate of the orbiting scroll and a sliding surface of the end plate of the fixed scroll slide against each other, an electric motor element which drives the scroll compressor element, a hermetic casing, an interior space of which houses the scroll compressor element and the electric motor element and holds lubricating oil collected at a bottom thereof, wherein the interior space of the hermetic casing is kept at an intermediate pressure between a suction pressure and a discharge pressure an oil separator disposed on a discharge side of the scroll compressor element, and an oil return mechanism, which intermittently returns lubricating oil from the oil separator into the hermetic casing, comprising an oil return passage that communicates with the oil separator and has an opening in the sliding surface of the end plate of the fixed scroll, and an oil pocket that is formed on a sliding surface of the end plate of the orbiting scroll and communicates alternately with the opening of the oil return passage and the interior space of the hermetic casing as the orbiting scroll revolves.

2. The hermetic type scroll compressor according to claim 1;

wherein an annular groove constantly communicating with the interior space of the hermetic casing is formed on the sliding surface of the end plate of the fixed scroll, and wherein the oil pocket communicates alternately with the oil return passage and the annular groove.

3. The hermetic type scroll compressor according to claim 1, wherein the oil return passage includes a vertical hole having an opening in the sliding surface of the end plate of the fixed scroll and a horizontal hole having an opening in a side of the end plate of the fixed scroll, and the oil return mechanism further comprises an oil return pipe which extends from the oil separator disposed outside the hermetic casing and penetrates through the hermetic casing and communicates with the horizontal hole formed in the oil return passage.

4. The hermetic type scroll compressor according to claim 1, wherein carbon dioxide is used as working fluid.

5. A hermetic type scroll compressor comprising: a scroll compressor element in which an end plate of a orbiting scroll and an end plate of a fixed scroll are assembled such that a sliding surface of the end plate of the orbiting scroll and a sliding surface of the end plate of the fixed scroll slide against each other, an electric motor element which drives the scroll compressor element, a hermetic casing, an interior space of which houses the scroll compressor element and the electric motor element and which holds lubricating oil collected at a bottom thereof, an oil separator disposed on a discharge side of the scroll compressor, an oil return mechanism is provided, which intermittently returns lubricating oil from the oil separator into the hermetic casing, comprising an oil return passage that communicates with the oil separator and has an opening in the sliding surface of the end plate of the fixed scroll, and an oil pocket that is formed on a sliding surface of the end plate of the orbiting scroll and communicates alternately with the opening of the oil return passage and the interior space of the hermetic casing, as the orbiting, scroll revolves, and wherein the oil pocket provides lubricating oil from around a circumference of the end plate of the orbiting scroll to the sliding parts of the end plate of the orbiting scroll and the end plate of the fixed scroll;

wherein the interior space of the hermetic casing is kept at an intermediate pressure between a suction pressure and a discharge pressure, and wherein carbon dioxide is used as working fluid.

6. The hermetic type scroll compressor according to claim 5, wherein the oil pocket comprises of a plurality of oiling grooves which are formed on the sliding part of the end plate of the orbiting scroll and which intermittently communicate with the interior space of the hermetic casing around the circumference of the end plate of the orbiting scroll and the opening in the fixed scroll.

7. The hermetic type scroll compressor according to claim 6, wherein the oiling grooves are formed along the entire circumference of the sliding part of the end plate of the orbiting scroll, and wherein the opening of the oil return passage is formed on a sliding part of the end plate of the fixed scroll comprises of an annular groove such that the annular groove intermittently communicates with the oiling grooves as the orbiting scroll revolves.

8. A refrigerating and air-conditioning apparatus having a refrigeration cycle system in which a hermetic type scroll compressor, a gas cooler, an expansion valve and an evaporator are connected with refrigerant piping:

wherein carbon dioxide is used as a refrigerant for the refrigeration cycle system;

wherein an interior space of a hermetic casing of the hermetic type scroll compressor is kept at an intermediate pressure between a suction pressure and a discharge pressure; and wherein the hermetic type scroll compressor includes;

a scroll compressor element in which an end plate of a orbiting scroll and an end plate of a fixed scroll are assembled such that they slide against each other, an electric motor element which drives the scroll compressor element, the interior space of the hermetic casing housing the scroll compressor element and the electric motor element and holding lubricating oil collected at a bottom thereof, an oil separator disposed on a discharge side of the scroll compressor element, and an oil return mechanism, which intermittently returns lubricating oil from the oil separator into the hermetic casing, comprising an oil return passage that communicates with the oil separator and has an opening in the sliding surface of the end plate of the fixed scroll, and an oil pocket that is formed on a sliding surface of the end plate of the orbiting scroll and communicates alternately with the opening of the oil return passage and the interior space of the hermetic casing as the orbiting scroll revolves.

9. The refrigerating and air-conditioning apparatus according to claim 8, wherein the oil return mechanism intermittently introduces lubricating oil from around a circumference of the end plate of the orbiting scroll to the sliding parts of the end plate of the orbiting scroll and the end plate of the fixed scroll.

* * * * *